US005392949A

United States Patent [19]

McKenna

[11] Patent Number: 5,392,949

[45] Date of Patent: Feb. 28, 1995

[54] UNIVERSAL BEVERAGE CONTAINER LID

[76] Inventor: Paul A. McKenna, D4 Millstone River Apt., Lakeview Ter., Princeton, N.J. 08540

[21] Appl. No.: 158,454

[22] Filed: Nov. 29, 1993

[51] Int. Cl.[6] ..... B65D 41/48; A47G 19/22

[52] U.S. Cl. ..... 220/712; 220/266; 220/276; 220/287; 220/711

[58] Field of Search ..... 220/276, 266, 268, 287, 220/703, 711, 712

[56] References Cited

U.S. PATENT DOCUMENTS

| | | | |
|---|---|---|---|
| 893,469 | 7/1908 | Essmuller | 220/287 X |
| 1,544,817 | 7/1925 | Davisson . | |
| 2,736,536 | 2/1956 | Banowitz | 220/287 X |
| 3,655,089 | 4/1972 | Tower | 220/287 |
| 4,202,459 | 5/1980 | De Parales et al. | 220/712 |
| 4,412,629 | 11/1983 | Dart et al. | 220/711 |
| 4,566,605 | 1/1986 | Rogers | 220/712 |
| 4,615,459 | 10/1986 | Clements | 220/254 |
| 4,627,537 | 12/1986 | Rogers | 220/712 X |
| 4,629,088 | 12/1986 | Durgin | 220/254 |
| 4,738,373 | 4/1988 | DeParales . | |
| 4,741,450 | 5/1988 | Braude . | |
| 4,898,292 | 2/1990 | Ver Weyst et al. | 220/254 X |
| 5,090,584 | 2/1992 | Roberts et al. | 220/712 |
| 5,197,624 | 3/1993 | Dodaro . | |

*Primary Examiner*—Allan N. Shoap
*Assistant Examiner*—Vanessa Caretto
*Attorney, Agent, or Firm*—Kenneth P. Glynn; Stephen J. Driscoll

[57] ABSTRACT

The present invention is directed at a lid for a cup. The lid comprising a disc having a periphery, a first face and a second face. The disc is corrugated to form a series of concentric, receiving channels having an opening and walls. The receiving channels are spaced apart so that both the first face and the second face can receive a cup wall of varying cup diameter. Additionally, the receiving channels have perforations to facilitate the removal of unused portions of the lid which extend radially outward from the cup wall. The lid has a tab which extends radially inward from the periphery of the disc and is formed by tab perforations on the disc. The tab hinges to the disc at a medial portion of the disc, and the tab can be opened by pivoting around the hinge and laying against the disc. Furthermore, the tab provides a starting point to tear along the perforations.

14 Claims, 2 Drawing Sheets

UNIVERSAL BEVERAGE CONTAINER LID

BACKGROUND OF THE INVENTION

1. Field of the Invention

The present invention relates generally to a lid for a drinking cup, and more specifically to a lid that fits all sizes of drinking cups.

2. Information Disclosure Statement

Beverages are often provided in disposable plastic or coated paper cups with a lid to prevent spillage.. The prior art includes several lid devices. For example, U.S. Pat. 1,544,817 teaches the use of a cover having jaws for the frictional attachment of the cover to the wall of a cup or glass. This device provides a protective lid to prevent spilling and splashing. U.S Pat. Nos. 4,738,373, 4,741,450, and 5,197,624 each teach the use of a lid with a hinged tab. The hinged cap allows the user to drink from the cup while the lid is in place.

Each of these inventions, however, fits only a particular cup size. Consequently, an inventory of different lid sizes must be stocked to accommodate the various cup sizes. The need to stock more than one size of lid increases costs and consumes administrative resources. Inevitably, waste results. Therefore, a need exists to eliminate the extra cost and clutter that accompanies stocking various sizes of lids. The present invention fulfills this need.

SUMMARY OF THE INVENTION

The present invention is directed at covering drinking cups and the like such that the contents contained within do not spill or splash.

One object of the present invention is to provide a lid to fit all size cups. The lid is corrugated to form a series of concentric receiving channels which alternate from one face of the lid to the other. These receiving channels are spaced apart to accommodate the wall of a drinking cup. Thus, the lid offers receiving channels on both faces to accommodate cups of varying diameters.

Another object of this invention is to provide perforations along the receiving channels. These perforations would allow the user to remove the peripheral, unused portion of the lid in the event a smaller cup is used.

Yet another object of this invention is to provide a tab on the lid such that the user can drink from the container while the lid remains in place. Although such tabs are well established in the prior art, the tab in the present invention offers synergistic benefits. First, by lifting the tab, the user can more easily strip away the unused portion of the lid; the tab provides a starting point at which to tear along the perforations. Second, the receiving channels serve to releasibly fasten the opened tab to the lid. This occurs because the hinge is positioned such that the receiving channels of the tab mesh with those of the lid, thus allowing the tap to snap in place.

BRIEF DESCRIPTION OF THE DRAWINGS

For a fuller understanding of the nature and object of the invention, the reader should take note of the detailed description taken in connection with the accompanying drawings in which.

DETAILED DESCRIPTION OF THE PRESENT INVENTION

Figure 1:
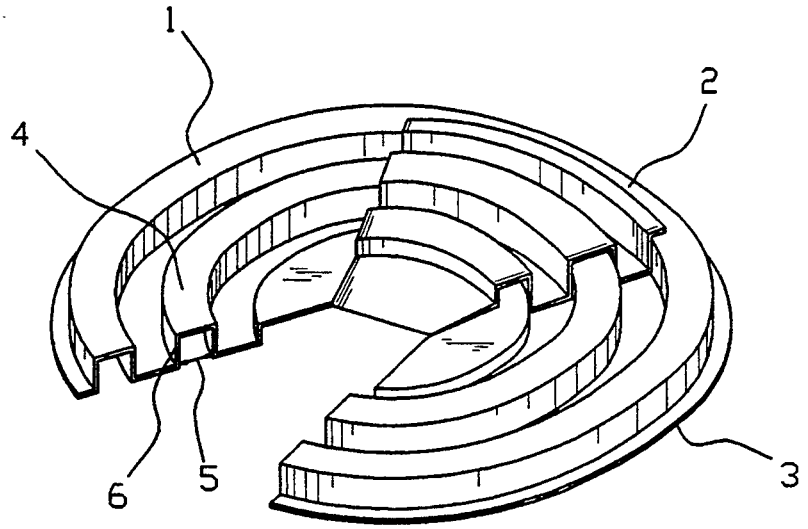
FIG. 1 depicts a preferred embodiment of the present invention.
Figure 2:
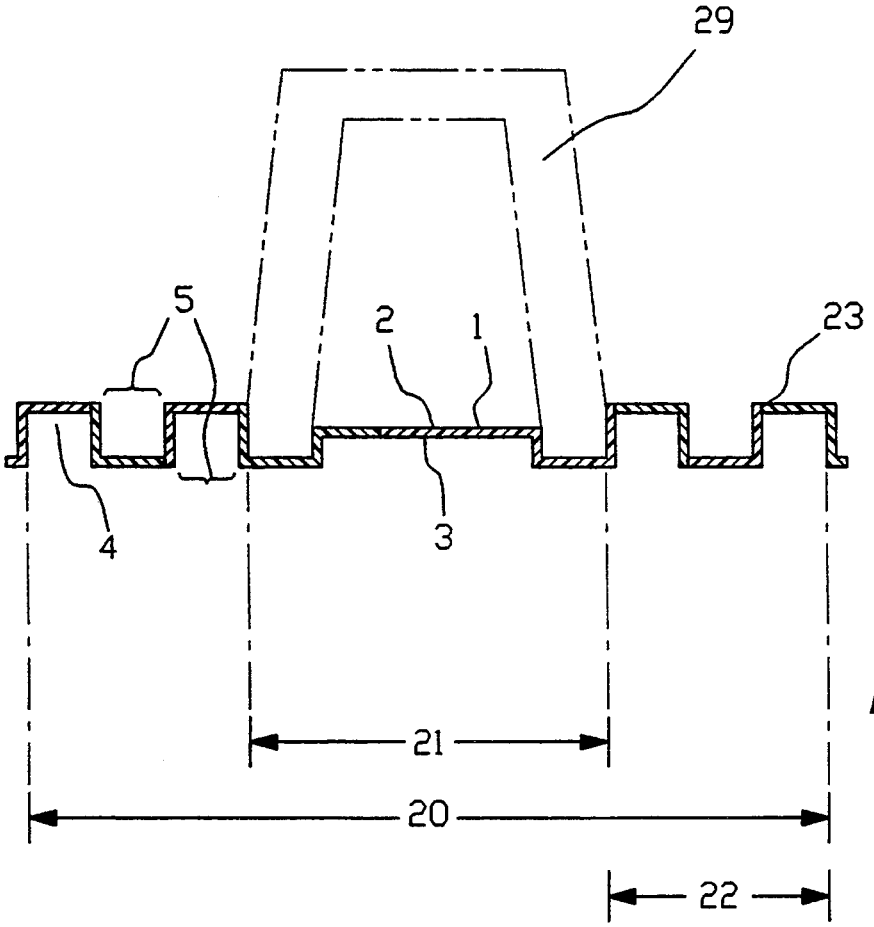
FIG. 2 shows a cross section of the preferred embodiment as depicted in FIG. 3

The invention is depicted in FIGS. 1 through 5, wherein like parts are like numbered. A preferred embodiment of the invention is depicted in FIG. 1. FIG. 1 shows a disc 1 having a first face 2 and a second face 3. Disc 1 is corrugated to form concentric, receiving channels 4. Receiving channels 4 have an opening 5, and walls 6. As shown in FIG. 2, Disc 1's corrugations are spaced apart such that receiving channels 4 can accommodate a cup's wall 29. Due to the corrugated nature of disc 1, opening 5 alternates between first face 2 and second face 3 such that the invention can receive cups on either face. This increases the range of sizes the invention can accommodate. As the embodiment of FIG. 2 shows, the invention can function on four different sized cups, ranging from a maximum cup diameter 20 to a minimum diameter 21. It should be understood, however, that the invention could be manufactured to accommodate any range of cups sizes.

Figure 3:
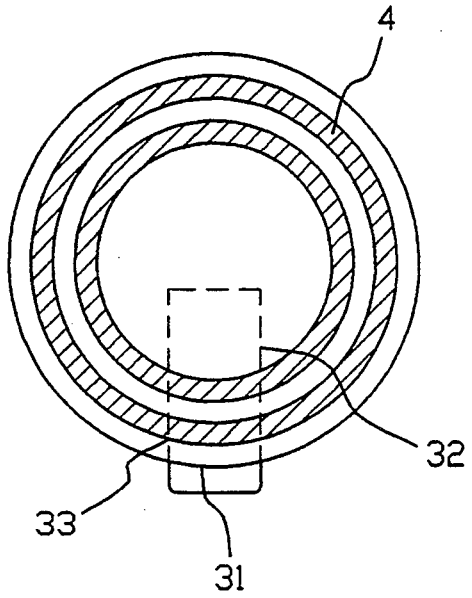
FIG. 3 shows a top view of the preferred embodiment.

If a cup smaller than diameter 20 is used, the peripheral, unused portion 22 can be removed by tearing along perforations 23. Perforations 23 allow a user to "customize" the universal lid to a particular cup size. One preferred embodiment of the invention has perforations 23 along the inner periphery of each receiving channel 4. To initiate the tear along perforations 23, a tab 31 is provided as shown in FIG. 3. Tab 31 is formed by tab perforations 32 located on disc 1. Tab 31 breaks the continuity of concentric receiving channels 4 and provides a starting point 33 to begin tearing.

Figure 4:
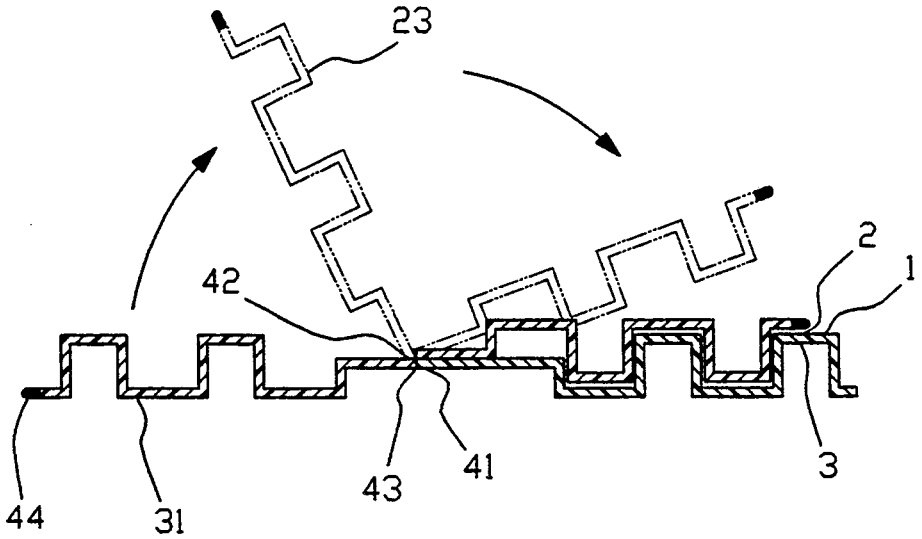
FIG. 4 is a depiction of the same cross section as in FIG. 2, but showing the pivoting motion of the tab, and a flap on the tab.

In addition to providing starting point 33 to tear along perforations 23, tab 31 also allows the user to drink while the lid remains in place. To open, tab 31 pivots around on a hinge 41, and releasibly attaches to disc 1 as shown in FIG. 4. Hinge 41 is formed by scoring disc 1. Since the invention is intended to fit a cup on either its first face 2 or second face 3, disc 1 must have scores on both faces—first score 42 and second score 43—so that tab 31 can pivot in either direction. The embodiment shown in FIG. 4 has a flap 44 extending beyond the periphery of tab 31. Flap 44 provides the user with an easy means to initiate the pivoting of tab 31.

Tab 31 releasibly attaches to disc 1 by receiving channels 4 interlocking. That is, hinge 41 is positioned such that when tab 31 is pivoted its receiving channels 4 mesh with the receiving channels 4 of disc 1. When the user forces tab 31 against disc 1, the two components snap together. To enhance the snapping action of tab 31 and disc 1, receiving channels 4 could vary in width such that a smaller receiving channel 4 of tab 31 would snap into a wider receiving channel 4 on disc 1. Additionally, score 42 and score 43 could be spaced differently to ensure that receiving channels 4 interlock regardless of the direction tab 31 pivots.

Figure 5:
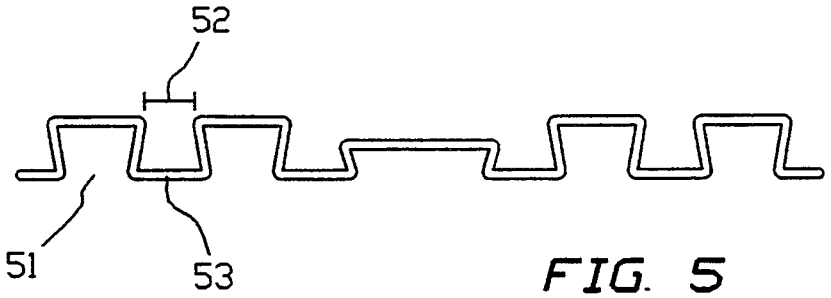
FIG. 5 depicts a cross section having the walls of the receiving channels converging on the opening.

FIG. 5 shows the invention with modified receiving channels 51, having an opening 52, and walls 53. Here, walls 53 converge on opening 52. This preferred embodiment enables receiving channels 51 to pinch the wall of the cup, and thus more securely hold the invention to the cup.

FIGS. 1, 2, 3, 4, and 5 present various embodiments of the same invention. These embodiments can be used independent of one another or they can be used in combination. It must be understood that many variations of the invention can be created. The embodiments shown depict the best mode of the invention, but it is obvious that numerous shapes, sizes and orientations can be used for all the parts described. It should be therefore understood that in light of the appended claims, the invention may be practiced other than as specifically described, and individual features described in differing embodiments may be modified, combined or used in orientations other than those shown.

What is claimed is:

1. A lid for a cup, said lid comprises:

a. a disc having a periphery, a first face and a second face, said disc is corrugated to form a series of concentric, receiving channels, each channel having an opening and walls, the openings alternate between said first face and said second face, said receiving channels are spaced apart such that both first face and said second face receive cup walls of varying cup diameter, said disc contains perforations along said receiving channels to facilitate the removal of unused portions of said lid.

2. The lid of claim 1, which further comprises:

b. a tab, said tab radially extends inward from said periphery of said disc, said tab formed by tab perforations on said disc, said tab hinged to said disc at a medial portion thereof, whereby said tab opens by pivoting around said hinge to lie against said disc.

3. The lid of claim 2 wherein said hinge is formed by scoring said first and second faces of said disc such that said tab pivots around said hinge in both directions.

4. The lid of claim 3 wherein said hinge is positioned such that when said tab pivots around said hinge, said receiving channels on said tab mesh with said receiving channels on said disc, thereby releasibly attaching said tab to said disc.

5. The lid of claim 2 wherein said tab extends beyond the periphery of said disc to form a flap, said flap facilitates easy opening of said tab.

6. The lid of claim 1 wherein said walls of said receiving channels narrow at said opening such that said receiving channels pinch a cup's wall.

7. A lid for a cup, said lid comprises:

a. a disc having a periphery, a first face and a second face, said disc is corrugated to form a series of concentric, receiving channels, each channel having an opening and walls, the openings alternate between said first face and said second face, said receiving channels are spaced apart such that both first face and said second face receive cup walls of varying cup diameter;

b. a tab, said tab radially extends inward from the periphery of said disc, said tab formed by tab perforations on said disc, said tab hinged to said disc at a medial portion thereof, whereby said tab opens by pivoting around said hinge to lie against said disc, said hinge is formed by scoring said first and second faces of said disc such that said tab pivots around said hinge in both directions, said hinge is positioned such that when said tab pivots around said hinge, said receiving channels on said tab mesh with said receiving channels on said disc, thereby releasibly attaching said tab to said disc.

8. The lid of claim 7 wherein said disc contains perforations along said receiving channels to facilitate the removal of unused portions of said lid.

9. The lid of claim 7 wherein said tab extends beyond the periphery of said disc to form a flap, said flap facilitates easy opening of said tab.

10. The lid of claim 7 wherein said walls of said receiving channels narrow at said opening such that said receiving channels pinch a cup's wall.

11. A lid for a cup, said lid comprises:

a. a disc having a periphery, a first face and a second face, said disc is corrugated to form a series of concentric, receiving channels, each channel having an opening and walls, the openings alternate between said first face and said second face, said receiving channels are spaced apart such that both first face and said second face receive cup walls of varying cup diameter; and b. a tab, said tab radially extends inward from the periphery of said disc, said tab formed by tab perforations on said disc, said tab hinged to said disc at a medial portion thereof, whereby said tab opens by pivoting around said hinge to lie against said disc, said hinge is positioned such that when said tab pivots around said hinge, said receiving channels on said tab mesh with said receiving channels on said disc, thereby releasibly attaching said tab to said disc.

12. The lid of claim 11 wherein said disc contains perforations along said receiving channels to facilitate the removal of unused portions of said lid.

13. The lid of claim 11 wherein said tab extends beyond the periphery of said disc to form a flap, said flap facilitates easy opening of said tab.

14. The lid of claim 11 wherein said walls of said receiving channels narrow at said opening such that said receiving channels pinch a cup's wall.

* * * * *